United States Patent [19]

Kanngiesser

[11] Patent Number: 4,588,428

[45] Date of Patent: May 13, 1986

[54] CONTROL METHOD FOR A LIQUID COOLED CABLE INSTALLATION

[75] Inventor: Karl W. Kanngiesser, Vierheim, Fed. Rep. of Germany

[73] Assignee: BBC Aktiengesellschaft Brown, Boveri & Cie AG, Baden, Switzerland

[21] Appl. No.: 659,656

[22] Filed: Oct. 11, 1984

[30] Foreign Application Priority Data

Oct. 11, 1983 [DE] Fed. Rep. of Germany ..... 3336842

[51] Int. Cl.[4] ..... F25D 17/02; H01B 7/34

[52] U.S. Cl. ..... 62/99; 62/201; 62/209; 165/104.33; 174/15 C

[58] Field of Search ..... 165/104.33, 40, 142, 165/80 C, 32; 62/201, 185, 208, 209, 98, 99; 174/15 R, 15 C, 16 R, 16 B, 11 R

[56] References Cited

U.S. PATENT DOCUMENTS 3,204,423 9/1965 Resh, Jr. ..... 62/209
3,946,141 3/1976 Schmidt ..... 174/15 C
3,946,142 3/1976 Kellow et al. ..... 174/15 C
4,459,818 7/1984 Kaya et al. ..... 62/201

FOREIGN PATENT DOCUMENTS 2252925 5/1974 Fed. Rep. of Germany .

*Primary Examiner*—Harry Tanner
*Attorney, Agent, or Firm*—Herbert L. Lerner; Laurence A. Greenberg

[57] ABSTRACT

Control method for a liquid-cooled cable installation with a hollow conductor, through which a coolant flows, as the cable conductor. The hollow space is divided in the longitudinal direction by partitions forming separate canals for the outgoing flow and the return of the coolant and in which canals the coolant is in contact with the conductor at high-voltage potential. Heat exchangers are provided at the start and the end of the cable system or at intermediate stations. The cable flow temperature ($\theta_Z$*) of the coolant is lowered with increasing load of the cable by influencing the heat exchanger and is conversely raised with falling load in such a manner that the mean value of the coolant ($\theta_m$) remains constant.

12 Claims, 5 Drawing Figures

CONTROL METHOD FOR A LIQUID COOLED CABLE INSTALLATION

BACKGROUND OF THE INVENTION

1. Field of the Invention

The invention relates to a control method for a liquid-cooled cable installation with a hollow conductor, through which a coolant flows, as the cable conductor, the hollow space of which is divided in the longitudinal direction by partitions forming separate canals for the outgoing flow and the return of the coolant and in which canals the coolant is in contact with the conductor at high-voltage potential. Heat exchangers are provided at the start and the end of the cable system or at intermediate stations.

2. Description of the Prior Art

A liquid-cooled cable installation is disclosed in German Pat. No. 22 52 925. Water is used as the coolant there.

The use of high-tension d-c for the transmission of energy via cables has the substantial advantage in that the cable requires no charging power. The copper cross section of the cable can therefore be used fully for the transmission of the active current, especially because there is also no skin effect. A further, very important advantage over the use of three-phase current is the fact that a substantially higher field strength can be applied to the cable dielectric, i.e., a substantially smaller insulation thickness will be sufficient for the same voltage. For the same dimensions of a cable, a substantially larger current can be transmitted if d-c is used and, in addition, a considerably higher voltage can be used. As compared to three-phase technology, several times the power can therefore be transmitted per cable.

Attempts are being made to compensate for, or at least reduce, this disadvantage of three-phase transmission through the use of artificially cooled cables. To this end, external cooling of the cable as well as internal cooling is used, wherein the cable conductor is designed as a hollow conductor. The external cooling generates fewer problems because the coolant (usually water because of its thermal properties) does not come into contact with voltage-carrying parts.

The advantages of cables with forced cooling are suggestive for use for d-c transmission. Here, however, a specific d-c problem is encountered with external cable cooling. For, contrary to a-c, the break-up of the voltage in the insulation of a d-c cable is determined by the ohmic resistance of the insulating material (generally oil-impregnated paper) in the case of d-c. As expected, the highest field strength occurs at the inner edge of the insulation, i.e. at the surface of the cable conductor, since there, due to the geometry, the ohmic resistance per mm of insulation is highest. Now, the ohmic resistance of cable paper is highly dependent on the temperature; relative to room temperature, the paper heated to the usual operating temperature of a cable can have a resistivity lower by orders of magnitude. This leads to the situation that in a fully loaded d-c cable, the field strength conditions are exactly reversed, i.e. the highest field strength now occurs at the outer circumference of the insulation, i.e. at the cold end.

Therefore, external cable cooling increases the temperature gradient across the cable insulation and thereby leads to a further relative increase of the field strength at the outer edge of the insulation as compared to the inner edge. Therefore, narrow limits are set for this technique; i.e. the current-carrying capacity of a d-c cable cannot be increased substantially by external cooling.

Quite in contrast thereto, the current load can be increased substantially with an internally cooled d-c cable because here, the heat flow is directed predominantly inward, i.e. toward the coolant, but not outward through the cable insulation. The above-described undesirable effect of a load-dependent increase of the field strength at the outer edge of the cable insulation is thereby largely avoided.

With internal cooling, the problem, of course, arises that the coolant, for instance water, is raised to the potential of the cable conductor.

In the known case, this problem is circumvented by connecting all devices required for the circulation and the cooling of the water likewise to high-voltage potential; for instance, the heat exchangers are to be installed insulated and ventilation units are driven via insulated shafts. Likewise, the pumps must be driven via insulating shafts or fed by a transformer with mutually insulated windings. The result of such an arrangement is then, of course, that devices for the contact-less transmission of data and control variables between high-voltage and ground potential must be provided.

This is a disadvantage, since maintenance work on the cooling devices is possible only with the cable disconnected, and the control by forced air cooling can be adapted to the temperature conditions only very roughly.

In the meantime, the technology of power transmission with high-tension d-c (HGÜ) has developed and utilized water-cooled thyristor valves, which has realized, technically reliably and at economically justifiable cost, the bridging of a potential difference of up to 500 kV d-c with deionized water, and dissipation heat to be removed which fully corresponds to a cable section 30 to 50 km long.

By applying the technique known from HGÜ it is therefore possible to bridge a sufficiently long cable section with service-friendly cooling equipment and control devices which are at ground potential.

With the self-suggesting design of the cable with a hollow conductor, through which the coolant flows in one direction, the cooling water is warmed up by an approximately constant temperature gradient per unit length. This determines of necessity a difference in the absolute temperature of the coolant and therefore, also of the cable between the entrance point and the exit point of the cooling water. This effect now leads, even though attenuated, to the above-described negative influence on the field strength distribution on the cable dielectric as a function of the cable load.

This negative effect can be avoided if the inner hollow conductor for the coolant is divided, as in the known case, by partitions in such a manner that separate canals are created for the outgoing flow and return of the coolant, where the outgoing and the return canals have the same contact area with the cable conductor and thereby the respective mean value ($\theta_m$) of the temperature of the outgoing ($\theta_Z$) and the returning ($\theta_R$) medium remains approximately constant over the entire length of the cable for the same heat supply per unit length, and thereby, also the temperature at the outer edge of the cable conductor remains constant practically over the entire length of the cable section.

While the thus described cable design assures the same temperature over the entire cable length, there nevertheless remains a dependence of the surface temperature of the cable conductor on the load because of the temperature rise in the coolant, which is dependent on the heat supplied.

SUMMARY OF THE INVENTION

An object of the invention is to provide a control method for a liquid-cooled cable installation of the kind mentioned at the outset, by means of which the temperature at the metallic hollow conductor surface and thereby, the field strength in the cable dielectric can be kept constant, independently of the load current or the loading of the cable.

With the foregoing and other objects in view, there is provided in accordance with the invention a control method for a liquid-cooled cable installation with a hollow conductor as the cable conductor, which comprises; flowing coolant through the hollow space of the cable conductor which is divided in the longitudinal direction by partitions to form separate canals for outgoing flow of coolant and return of coolant, with the coolant flowing in the canals in contact with the conductor at high voltage potential, and flowing coolant through a heat exchanger, the combination therewith of lowering the cable outgoing flow temperature ($\theta_Z$) of the coolant with increasing load of the cable by means of the heat exchanger and conversely with falling load raising the cable outgoing flow temperature ($\theta_Z$) of the coolant, to maintain the mean value of the coolant ($\theta_m$) constant.

In accordance with the invention there is provided a control method for a liquid-cooled cable installation with a hollow conductor as the cable conductor, which comprises; flowing coolant through the hollow space of the cable conductor which is divided in the longitudinal direction by partitions to form separate canals for outgoing flow of coolant and return of coolant, with the coolant flowing in the canals in contact with the conductor at high voltage potential, and flowing coolant through a heat exchanger, the combination therewith of lowering the mean temperature value ($\theta_m$) of the cable return temperature ($\theta_R$*) and the cable outgoing flow temperature ($\theta_z$*) of the coolant with increasing loading of the cable and, conversely, with dropping load, raising the mean temperature value ($\theta_m$) to maintain the surface temperature of the cable conductor constant independently of the load.

Other features which are considered as characteristic for the invention are set forth in the appended claims.

Although the invention is illustrated and described herein as embodied in a control method for a liquid-cooled cable installation, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

Figure 1:
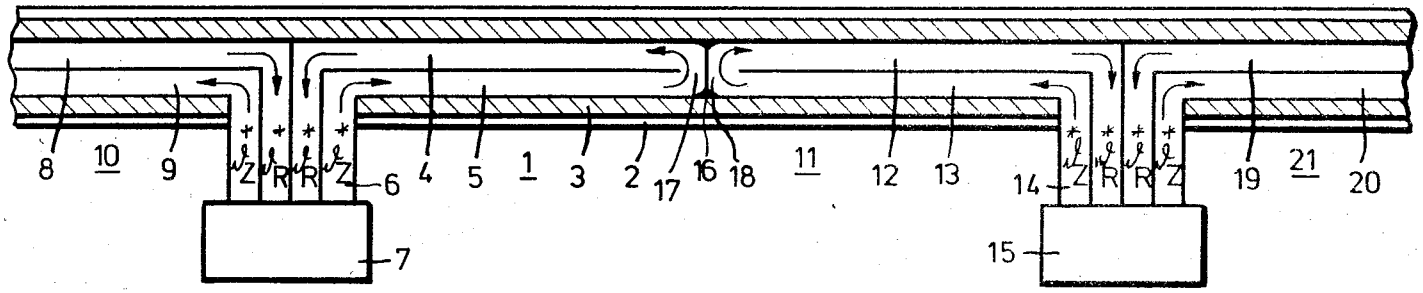
FIG. 1 diagrammatically illustrates a longitudinal section of a liquid-cooled cable installation in accordance with the invention.

The advantages obtainable with the invention are in particular that a very uniform temperature is obtained over the entire cable length. Because of the exact temperature control, the field strength along the cable section remains constant, which makes for a cable installation which has narrow tolerances and is thereby economical without the danger that voltage breakdowns may occur due to an increase of the field strength.

The invention will be explained in the following with the aid of the embodiment examples shown in the drawings.

In FIG. 1, the design of a liquid-cooled cable installation is shown in a longitudinal section. This is the cable of a high-voltage d-c transmission system (HGÜ), in which the coolant, preferably deionized water, is conducted out and back in the inner hollow conductor of the cable. For a better control, the HGU cable (d-c cable) is subdivided into several cable sections which are electrically connected directly, but are separated hydraulically; in FIG. 1, for instance, four such cable sections are shown.

For shorter cable sections, the subdivision into hydraulically separated sections can be omitted altogether, so that then, the cable system need contain only one heat exchanger.

A first HGÜ cable section 1 has an outer insulating layer 2 (cable dielectric), for instance oil-impregnated paper, as well as an inner metallic hollow conductor 3. The design of the cable sections 10, 11 and 21 is the same. The outer insulating layer can be provided with a protective jacket, not shown, for improving the mechanical strength. The inner metallic hollow conductor is divided in half by a partition in the longitudinal direction to create two hydraulically separated cooling canals. In this manner, a first return canal 4 and a first outgoing flow canal 5 are formed. These two first canals are connected via a first connecting nozzle 6 to a first heat exchanger 7. The arrows in the canals indicate the respective flow direction of the coolant.

The connecting nozzle 6 serves further for the hydraulic connection of a second return canal 8 and the second outgoing flow canal 9 of the second HGÜ cable section 10 to the heat exchanger 7. The two cable sections 1 and 10 are at the same d-c potential but hydraulically separated from each other, and each have separate coolant loops.

A third HGÜ cable section 11 with a third return canal 12 and a third outgoing flow canal 13 is connected to a second heat exchanger 15 via a second connecting nozzle 14. The third cable section 11 has approximately the same length as the first cable section 1 and is electrically connected thereto. For the hydraulic separation of the two cable sections 1, 11, a partition 16 is provided in the hollow space of the metallic hollow conductor 3, which separates the two return canals 4, 12 as well as the two outgoing canals 5, 13 from each other. A hydraulic connection between the return canal 4 and the outgoing canal 5 of the first cable section 1 is created by means of a passage opening 17 near the partition 16. Similarly, a passage opening 18 near the partition 16 serves for the direct connection of the outgoing flow canal 13 to the return canal 12 of the third cable section 11.

The heat exchanger 15 is connected further, via the connecting nozzle 14, to a fourth return canal 19 and a fourth outgoing flow canal 20 of a fourth HGÜ cable section 21.

The cable of the HGÜ system may include, in addition to the four cable sections 1, 10, 11 and 21 shown and described, further cable sections with each section having a separate cooling loop with heat exchanger. Thus, for instance, the two cable sections 10 and 21 may each be connected to further cable sections, not shown which additional sections are cooled by separate heat exchangers. Further partitions for the hydraulic separation are then provided in the metallic hollow conductors 3 at the midpoint of the cable between two heat exchangers.

Two sections can also be connected hydraulically in series; the partition 16 as well as the openings 17 and 18 of FIG. 1 can then be omitted. The two associated cooling devices 7 and 15 are then likewise connected in a series hydraulically.

The bridging of the potential difference acting on the cooling liquid between the voltage-carrying hollow conductor 3 of the HGÜ cable and ground takes place in the heat exchangers 7 and 15. The technique used here is analogous to the generally known HGÜ technique for liquid-cooling converter valves. If water is used as the coolant, hydraulic sections are formed by arranging the canal, optionally twisted, of a length that the high d-c potential is reliably broken up.

After the potential difference is broken up, cooling liquid is cooled by means of water/water or water/air heat exchangers (outer cooling loops). Thereby, all auxiliary and measuring devices of the cooling loop are advantageously at ground potential. Auxiliary devices which should be mentioned particularly are the blower which may be necessary for cooling the cooling liquid (in the case of water/air heat exchangers) and the circulating pumps required for circulating the primary and secondary cooling liquid (in the case of water/water heat exchangers). Flow rate measuring devices and temperature measuring devices should be provided at the outgoing flow and return.

Figure 2:
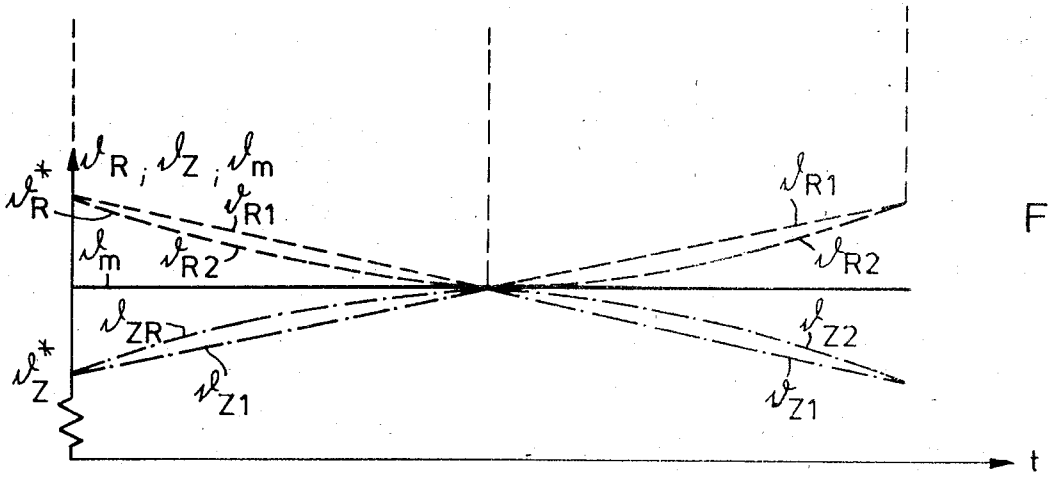
FIG. 2 shows the inflow and return temperatures of coolant along individual cable sections.

In FIG. 2, the temperature along individual cable sections of the HGÜ cable system is shown. The cooling liquid is fed from the heat exchanger 7 via the connecting nozzle 6 with a cable inflow temperatue $\theta_Z^*$ to the inflow canal 5 of the first cable section 1. The cooling liquid is continuously heated up along the cable section 1 due to the dissipation of heat occurring in the operation of the d-c cable and reaches a mean temperature value $\theta_m$ at the partition 16 or the passage opening 17. The pattern of the cable inflow temperature is designated with $\theta_z$, where the linear temperature curve $\theta_{Z1}$ applies for the unrealistic assumption of thermal insulation between the outgoing flow canal and the return canal, while the curved temperature pattern $\theta_{Z2}$ takes into consideration the imperfect thermal insulation between the canals.

The cooling liquid, after passing through the passage opening 17, enters the return canal 4 and is heated further there. The shape of the cable return temperature is designated with $\theta_R$. When leaving the canal 4 and passing into the heat exchanger 7 through the nozzle 6, the cooling liquid has the cable return temperature $\theta_R^*$. The temperature curve $\theta_{R1}$ applies for ideal thermal insulation between the two longitudinal canals, and the temperature curve $\theta_{R2}$ for the realistic, imperfect thermal insulation.

It can be seen from FIG. 2 that this imperfect thermal insulation has no effect on the operation of the schematic cooling arrangement, because the curve $\theta_m$ of the mean temperature value of the outgoing flow and the return $\theta_m=(\theta_R+\theta_Z)/2$ is constant along the cable section 1. This mean temperature value $\theta_m$ also remains constant along the following cable section 11 and has the same level as in the cable section 1. The cooling liquid is fed here to the outgoing flow canal 13 by the connecting nozzle 14 from the heat exchanger 15 at a temperature $\theta_Z^*$, flows through the passage opening 18 at a temperature $\theta_m$ and arrives through the return canal 12 and the connecting nozzle 14 back into the cooler heat exchanger 15 at a temperature $\theta_R^*$. The temperature curves along the cable section 11 are again designated $\theta_{R1}$, $\theta_{R2}$, $\theta_{Z1}$, $\theta_{Z2}$.

Figure 3:
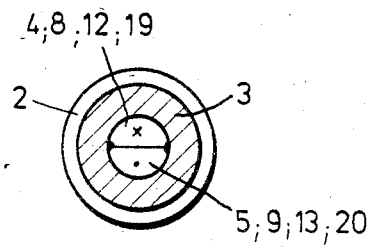
FIG. 3 illustrates the liquid-cooled cable in a cross section, FIG. 4 relates the load-dependent control to the cable inlet temperature, and FIG. 5 relates the load-dependent control to the mean value of the temperature of the outgoing low and the return.

The liquid-cooled cable is shown in cross-section in FIG. 3. The outer insulating layer 2 as well as the hollow-cylindrical metallic conductor 3 can be seen. The hollow space of hollow conductor 3 is semi-circularly divided to form inflow canals 4, 8, 12, 19 as well as return canals 5, 9, 13, 20.

The hollow space of the hollow conductor 3 can, in addition, also be divided by approximately cross-shaped separating bodies, to form two inflow canals and two return canals and the two diagonally opposite canals are connected in parallel from a cooling point of view.

Because of the distributed heat development of the cable, the cooling liquid is heated by approximately a constant temperature gradient per unit length. Since the inflow and the return canals have the same contact area with the heat-producing cable conductor, the heat supply per unit length is approximately constant over the entire cable length. Because the mean temperature value $\theta_m$ is constant over the entire length of the cable, the temperature of the cable conductor also remains constant, which advantageously results in constant field strength in the dielectric over the entire length of the cable.

The cable design described above assures a constant mean temperature value over the entire cable length by using the counterflow principle. Nevertheless, the temperature of the hollow conductor 3 remains dependent on the load because of the temperature rise of the cooling medium which is dependent on the heat supplied. Therefore, the cable inflow temperature $\theta_Z^*$ of the coolant is controlled by influencing the secondary cooling loop (for instance, blowers) in the heat exchangers to maintain the mean temperature value $\theta_m$ of the inflow and the return constant independently of the load.

Figure 4:
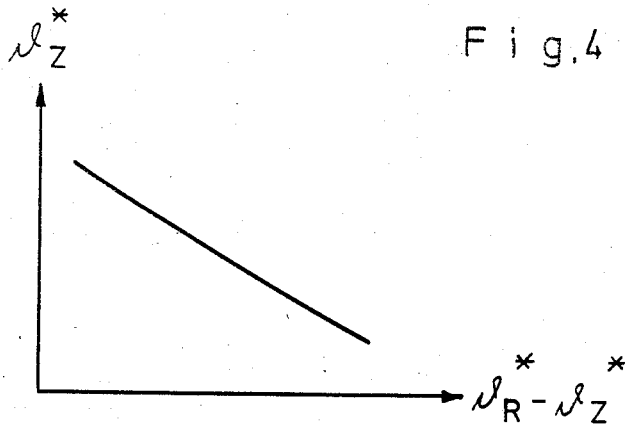

In this connection, the load-dependent control of the cable inflow temperature is shown in FIG. 4, using a measure of the cable loading the difference $\theta_R^*-\theta_Z^*$ of the return and the inflow temperatures. This temperature difference is proportional to the load for constant cooling-liquid flow. With increasing load, the cable inflow temperature $\theta_Z^*$ is lowered, so that the mean temperature value $\theta_m$ remains constant. However, the load-dependent temperature gradient between the outer and the inner surface of the hollow conductor 3 is not taken into consideration. If the surface temperature of the hollow conductor 3 and thereby, the field strength in the insulating layer 2 (cable dielectric) are to be determined independently of the load, the mean temperature value $\theta_m$ of the inflow and return must be controlled dependent on the load.

Figure 5:
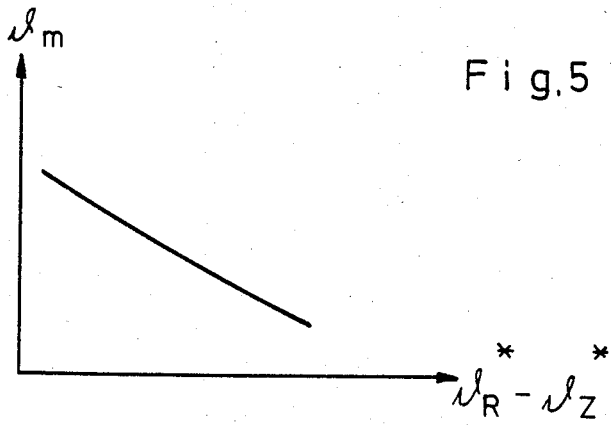

In FIG. 5 the load-dependent control of the mean temperature value $\theta_m$ is shown in this connection. The temperature difference $\theta_R^* - \theta_Z^*$ again serves as a measure for the load, where at the same time the thermal timed constant of the cable is taken into consideration. With increasing load, the mean temperature value $\theta_m$ of the inflow and return is lowered, so that the surface temperature of the cable conductor 3 and thereby the field strength in the insulating layer 2 remain constant. For lowering the mean temperature value as a function of the load, the cable inflow temperature $\theta_Z^*$ must be lowered more with increasing load than with the constant control of $\theta_m$ shown in FIG. 4.

There is claimed:

1. Control method for controlling the field strength in a cable dielectric of a liquid-cooled cable installation with a hollow conductor as the cable conductor and an outer insulating layer as the cable dielectric without the danger that voltage breakdowns may occur due to an increase of the field strength, which comprises; flowing coolant through the hollow space of the cable conductor which is divided in the longitudinal direction by partitions to form separate canals for outgoing flow of coolant and return of coolant, with the coolant flowing in the canals in contact with the conductor at high voltage potential, and flowing coolant through a heat exchanger, the combination therewith of lowering the cable outgoing flow temperature ($\theta_Z$) of the coolant with increasing load of the cable by means of the heat exchanger and conversely with falling load raising the cable outgoing flow temperature ($\theta_Z$) of the coolant, to maintain the mean value of the coolant ($\theta_m$) constant.

2. Control method according to claim 1, wherein heat exchangers are provided at the start and the end of the cable.

3. Control method according to claim 1, wherein heat exchangers are provided at intermediate stations.

4. Control method according to claim 1, wherein the difference between the cable return temperature ($\theta_R^*$) of the coolant and the cable outgoing flow temperature ($\theta_Z^*$) of the coolant is employed as a measure for the loading of the cable.

5. Control method according to claim 2, wherein the difference between the cable return temperature ($\theta_R^*$) of the coolant and the cable outgoing flow temperature ($\theta_Z^*$) of the coolant is employed as a measure for the loading of the cable.

6. Control method according to claim 3, wherein the difference between the cable return temperature ($\theta_R^*$) of the coolant and the cable outgoing flow temperature ($\theta_Z^*$) of the coolant is employed as a measure for the loading of the cable.

7. Control method for controlling the field strength in a cable dielectric of a liquid-cooled cable installation with a hollow conductor as the cable conductor and an outer insulating layer as the cable dielectric without the danger that voltage breakdowns may occur due to an increase of the field strength, which comprises; flowing coolant through the hollow space of the cable conductor which is divided in the longitudinal direction by partitions to form separate canals for outgoing flow of coolant and return of coolant, with the coolant flowing in the canals in contact with the conductor at high voltage potential, and flowing coolant through a heat exchanger, the combination therewith of lowering the mean temperature value ($\theta_m$) of the cable return temperature ($\theta_R^*$) and the cable outgoing flow temperature ($\theta_z$) of the coolant with increasing loading of the cable and, conversely, with dropping load, raising the mean temperature value ($\theta_m$) to maintain the surface temperature of the cable conductor constant independently of the load.

8. Control method according to claim 7, wherein heat exchangers are provided at the start and the end of the cable.

9. Control method according to claim 7, wherein heat exchangers are provided at intermediate stations.

10. Control method according to claim 7, wherein the difference between the cable return temperature ($\theta_R^*$) of the coolant and the cable outgoing flow temperature ($\theta_Z^*$) of the coolant is employed as a measure for the loading of the cable.

11. Control method according to claim 8, wherein the difference between the cable return temperature ($\theta_R^*$) of the coolant and the cable outgoing flow temperature ($\theta_Z^*$) of the coolant is employed as a measure for the loading of the cable.

12. Control method according to claim 9, wherein the difference between the cable return temperature ($\theta_R^*$) of the coolant and the cable outgoing flow temperature ($\theta_Z^*$) of the coolant is employed as a measure for the loading of the cable.

* * * * *